US005377422A

United States Patent [19]

Newman

[11] Patent Number: 5,377,422

[45] Date of Patent: Jan. 3, 1995

[54] ROLLER FRAME ALIGNMENT BRACKET

[75] Inventor: Donald E. Newman, Wyncote, Pa.

[73] Assignee: Stretch Devices, Inc., Philadelphia, Pa.

[21] Appl. No.: 143,791

[22] Filed: Oct. 26, 1993

[51] Int. Cl.[6] ..... B41B 11/00; B41F 1/34

[52] U.S. Cl. ..... 33/620; 33/614; 38/102.1; 160/378; 101/127.1

[58] Field of Search ..... 33/614, 617, 620; 38/102, 102.1, 102.4, 102.6, 102.91; 101/127.1, 128, 128.1, 415.1; 160/327, 328, 329, 378, 395

[56] References Cited

U.S. PATENT DOCUMENTS

| | | | |
|---|---|---|---|
| 1,072,908 | 9/1913 | Buda | 33/614 |
| 2,701,420 | 2/1955 | Monroy et al. | 33/614 |
| 3,098,431 | 7/1963 | Weaver | 33/614 |
| 4,226,181 | 10/1980 | Ericsson | 33/614 |
| 4,516,495 | 5/1985 | Ericsson | 33/614 |
| 5,127,176 | 7/1992 | Newman | 101/127.1 |
| 5,163,367 | 11/1992 | Newman | 101/127.1 |

*Primary Examiner*—William A. Cuchlinski, Jr.

*Assistant Examiner*—G. Bradley Bennett

*Attorney, Agent, or Firm*—Seidel, Gonda, Lavorgna & Monaco

[57] ABSTRACT

A registration/adapter apparatus aligning a printing screen with an image platform. A screen tensioning and printing frame has four tensioning rollers coupled together by corner members. The corner members support the rollers for rotation about their longitudinal axis. Each roller has a channel for retaining an edge of a screen fabric. A bolt associated with each corner member locks each roller in a predetermined rotative position to hold the screen fabric at the desired tension. One of the rollers has a pair of associated adapters interposed between the head of the bolt and the associated corner member. The adapter has a hole on one surface and a slot on the opposite surface. A registration member associated with the image platform has a pair of pins for aligning and being received by the hole and slot in the adapter associated with the screen tensioning and printing frame. The pins received by the hole and slot ensure alignment of the screen tensioning printing frame with the image platform.

3 Claims, 4 Drawing Sheets

ROLLER FRAME ALIGNMENT BRACKET

FIELD OF THE INVENTION

This invention relates to a registration system for a screen printing roller frame and screen and particularly to an adapter received by the roller frame and screen for coupling with a plurality of pins on a registration bracket.

BACKGROUND OF THE INVENTION

In the majority of screen priming operations, more than one color is used to create the desired image. The use of more than one color results in using several screens, one for each color, wherein each screen has the associated image for that color. It is therefore necessary to ensure that the images from each screen align properly so that the associated colors align properly. This is typically done by ensuring that the screen is properly aligned in the frame and aligning the frame to a platform which receives the article that is to receive the image.

One convention is to attach the rigid frame to a registration adapter, wherein the registration adapter has a stationary bar and a movable bar that pivots up and down relative to the stationary bar. At the end of that movable bar is located a U-shaped channel. The U-shaped channel has a pair of operating screws with swivel heads that rotate to engage the frame. The frame moves with the movable bar downward in proximity with the article and the platform to align the image on the screen with the article so that the image may be transferred to the article. It is a trial and error process to align the frame in the U-shaped channel to achieve proper alignment.

Tensioning frames replace the rectangular sides of the frame with tensioning rollers. The curved rollers created a difficult surface to engage to secure to the registration adapter for proper alignment. One design to overcome this problem is a tensioning frame that has three tensioning rollers and a square side which is not adjustable. Furthermore, the frame to achieve the desired result from high tension screens must be tensioned periodically. The use of one square non-rotatable side does not achieve all the benefit of four tension sides.

It is desired to have a registration means that allows easy accurate alignment and in addition allows the several different frames to be received without changes to a registration bar.

SUMMARY OF THE INVENTION

The present invention relates to a registration-/adapter apparatus for aligning a printing screen with an image platform. A screen tensioning and printing frame has four tensioning rollers coupled together by corner members. The corner members support the rollers for rotation about their longitudinal axis. Each roller has a channel for retaining an edge of a screen fabric. A bolt associated with each corner member locks each roller in a predetermined rotative position to hold the screen fabric at the desired tension. One of the rollers has a pair of associated adapters interposed between the head of the bolt and the associated corner member. The adapter has a hole on one surface and a slot on the opposite surface. A registration member associated with the image platform has a pair of pins for aligning and being received by the hole and slot in the adapter associated with the screen tensioning and printing frame. The pins received by the hole and slot ensure alignment of the screen tensioning printing frame with the image platform.

A bar movable by a pair of air cylinders engages the corner members to secure the screen tensioning and printing frame to the registration member.

Further objects, features and advantages of the present invention will become more apparent to those skilled in the an as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
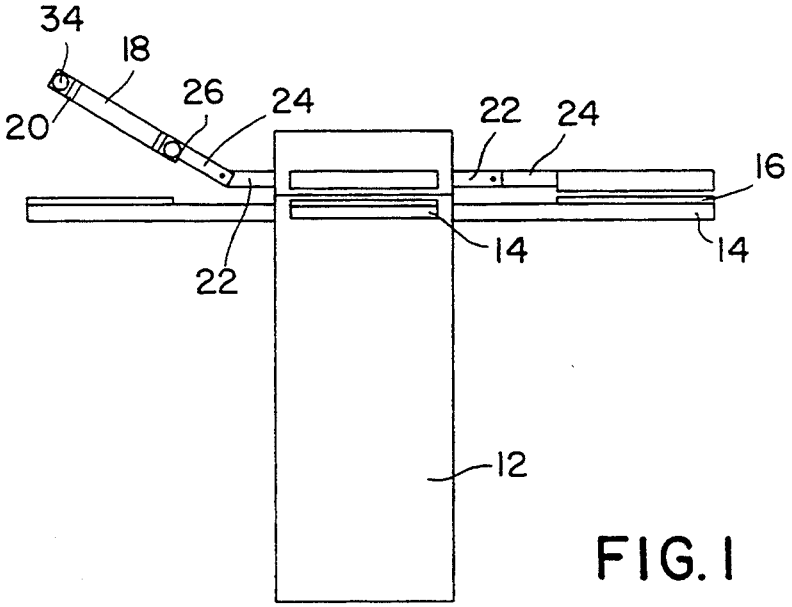
FIG. 1 is a schematic of a screen printer having an image platform and a roller mesh frame screen aligned by a registration/adapter apparatus of the present invention.

Referring to the drawings in detail, where like numerals indicate like elements, there is illustrated a device in accordance with the present invention designated generally as 10.

Referring to FIG. 1, a printer station 12 has a platform 14 for receiving an article 16, such as a shirt or a poster, to place the image on. A roller frame 18 has a screen 20 which contains an image which is to be transferred to the article 16. The station printer 12 has a stationary registration bar 22 and a movable registration bar 24 pivotable to the movable registration bar 24 relative to the stationary registration bar 22. The movable registration bar 24 has at an end opposite the stationary registration bar 22, a registration apparatus 26 having of a plate 28 and a "U" shaped channel 30.

The registration apparatus 26 is a part of registration-/adapter apparatus 10 of this invention which connects the roller frame 18 to the movable registration bar 24, such that as the movable registration bar 24 is moved downward, the image on the screen 20 is properly aligned with the article on the platform 14. Typically the stationary registration bar 22 and movable registration bar 24 rotates relative to the platform, such that a single roller frame 18 aligns with several platforms 14 upon rotation.

Figure 2:
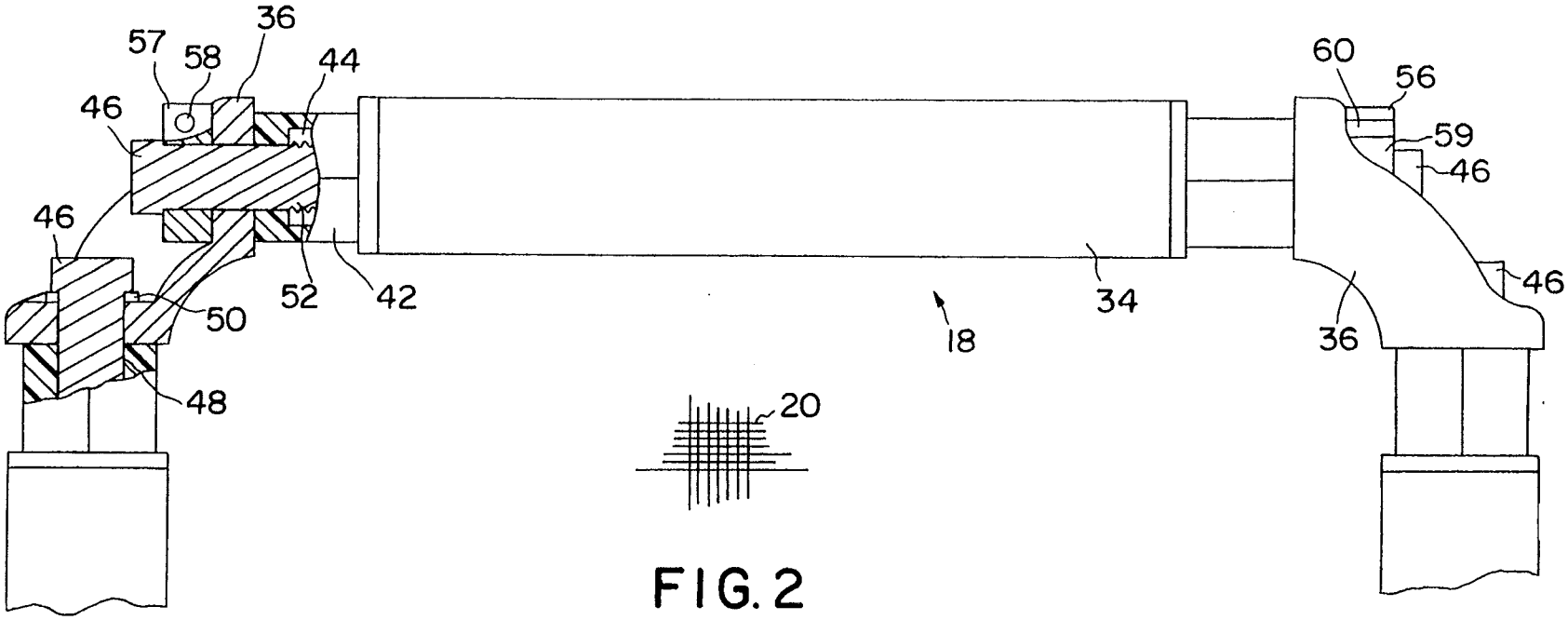
FIG. 2 is a broken out portion of the roller frame having an adapter.

Referring to FIG. 2, the roller frame 18 has four rollers 34 (only three shown) and four corner members 36 (only two shown). Each roller 34 extends between two corner members 36 and has a pair of end plugs 42. Each end plug 42 contains a nut 44. A bolt 46 having a shaft 48, extends through a washer 50 and the corner member 36 with a threaded portion 52 received by the nut 44. The screen 20 (only a portion is shown) is secured to the rollers 34, and tension in the screen is created by rotation of the rollers 34. The tension is maintained by locking the rollers 34 at a predetermined rotated position by securing the bolt 46 to the nut 44. U.S. Pat. No 5,127,176 discloses a similar construction of the roller frame 18 and is herein incorporated by reference.

A pair of washers 50 associated with one of the rollers 34 are replaced by a pair of registration adapters 56. The registration adapters 56 are identical and preferably made of harden steel or other suitable material. The adapters 56 are mounted adjacent to the corner members 36 so that a surface 57 having a hole 58 is positioned downward on one of the registration adapters 56 and a surface 59 having a slot 60 is positioned downward on the other registration adapter 56.

Figure 3:
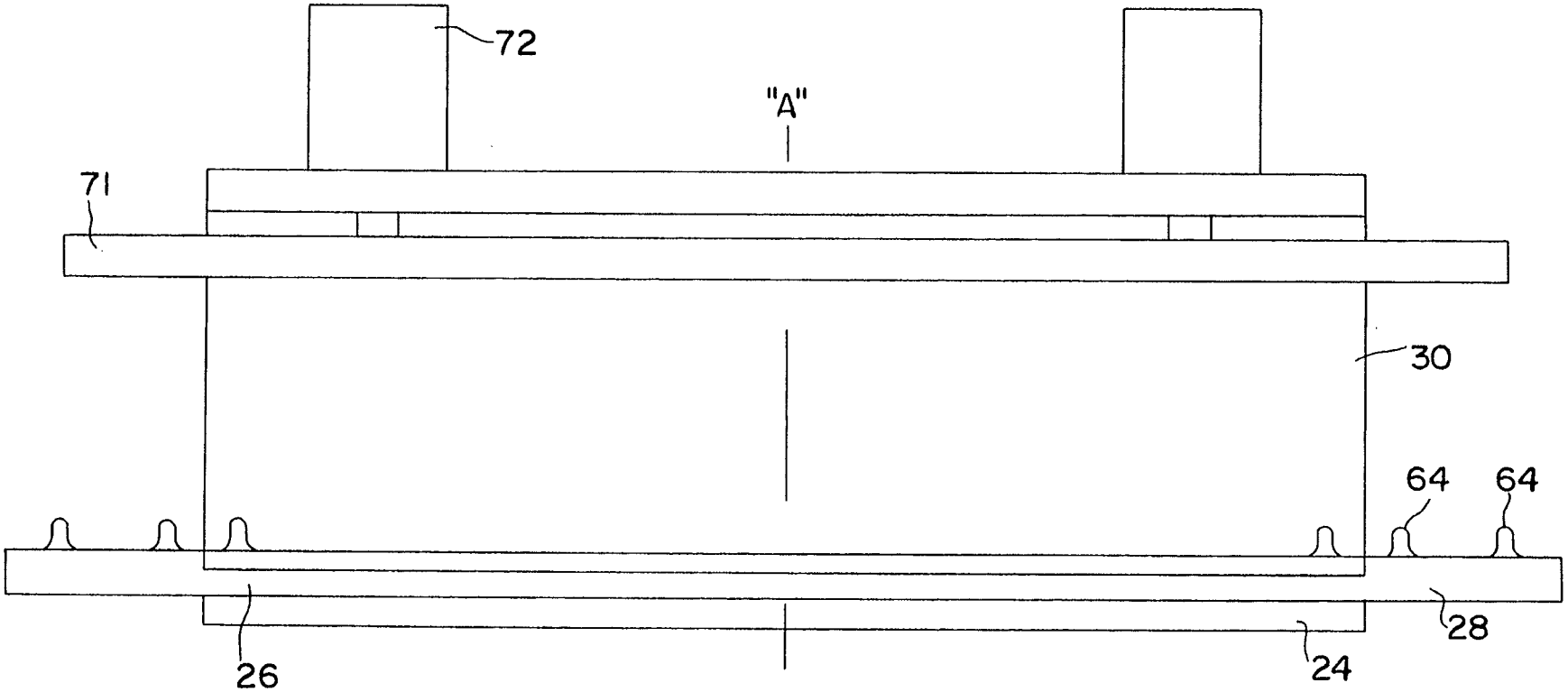
FIG. 3 is side view of the registration bar.

Referring to FIG. 3, the "U" shaped channel 30 and the plate 28 of the registration apparatus 26 are secured to each other. The plate 28 is secured to the movable registration bar 24 and has a plurality of pins 64. The pins 64 are symmetric about a center line "A" and positioned for varying size roller frames 18. In addition, pins 64 have a tapered shape to ease alignment.

Figure 4:
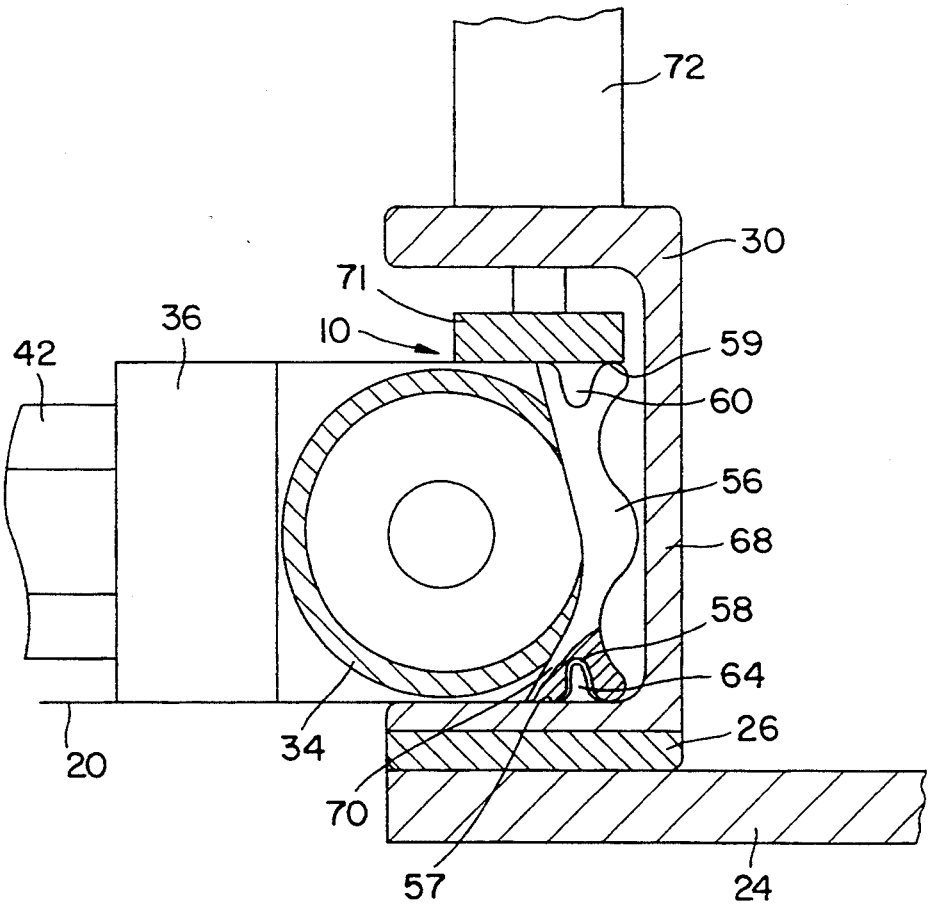
FIG. 4 is a section view of the registration bar and the roller frame with a portion of the roller and corner member broken away.

Referring to FIG. 4, the hole 58 of the registration adapter 56 of the roller frame 18 receives one of the pins 64 located in the plate 28 to position the roller frame 18 relative to the registration apparatus 26 of the movable registration bar 24. The slot 60 in the other registration adapter 56 of the roller frame 18 assist in the alignment by preventing rotation of the roller frame 34 about the pin 64/hole 58 connection. The pins 64 in the movable registration bar 24 are position in proximity to a base 68 of the "U" shaped channel 30 so that those pins 64 which do not align with the hole 58 and slot 60 in the registration adapter 56, do not interfere with roller frame 18, more specifically the roller 34. The pins 64 are received in a gap 70 to be defined by the base 68 and the roller 34, and do not project into engagement with the roller 34. The hole 58 and the slot 60 are tapered similarly to the pins 64 to ease insertion of the pins and ensure alignment.

In operation, the screen 20 is attached properly to the roller frame 18. The bolts 46 are loosen and the screen 20 is tensioned by rotation of the rollers 34 via rotation of the end plugs 42. The bolts 46 are then retighten. The roller 34 associated with the adapters 56 is tensioned similarly to the others.

After the screen 20 is tensioned properly on the roller frame 18, a stencil containing the image is placed on a set board (not shown). The set board has a series of horizontal lines including a center line and a series of vertical lines for alignment of the stencil. In addition, the set board has pins, similar to the pins 64 of the plate 28 of the registration apparatus 26. After the stencil is secured to the set board by any of the numerous ways, including vacuum, the roller frame 18 is placed on the set board with the hole 58 and slot 60 receiving the pins on the set board. The stencil is then secured to the frame and therefore properly aligned with the roller frame 18. An alternative to the horizontal and vertical lines on the set board is an additional set of pins that receive holes located in the stencil to ensure alignment of the stencil with the roller frame 18.

Referring to FIG. 4, the roller frame 18 with the adapters 56 are positioned in the "U" shaped channel 30 of the registration apparatus 26. The adapters 56 are lowered on to the pins 64, wherein one of the pins 64 is received by the hole 58 and another pin 54, the pin symmetrically positioned relevant to the center line "A", by the slot 60. The slot 60 allows for slight variation in roller frame size. The pins 64 not received by the adapters 56 are either located outside of the roller frame 18 or are positioned in the gap 70 created by the roller 34.

The roller frame 18 is additionally secured to the registration apparatus 26 by a bar 71 which is lowered into engagement with the corner member 36 by a pair of air cylinders 72 therein preventing the roller frame 18 from moving off the pins 64.

Referring to FIG. 1, with the roller frame 18 properly aligned, the roller frame 18 moves down with the movable registration bar 24 to allow the transfer of the image from the screen 20 to the article 16. The movable registration bar 24 moves upward to allow either another article 16 to be placed on the platform 14 or to rotate the registration bars 24 and 26 on the printer 12 relative to the platform.

Figure 5:
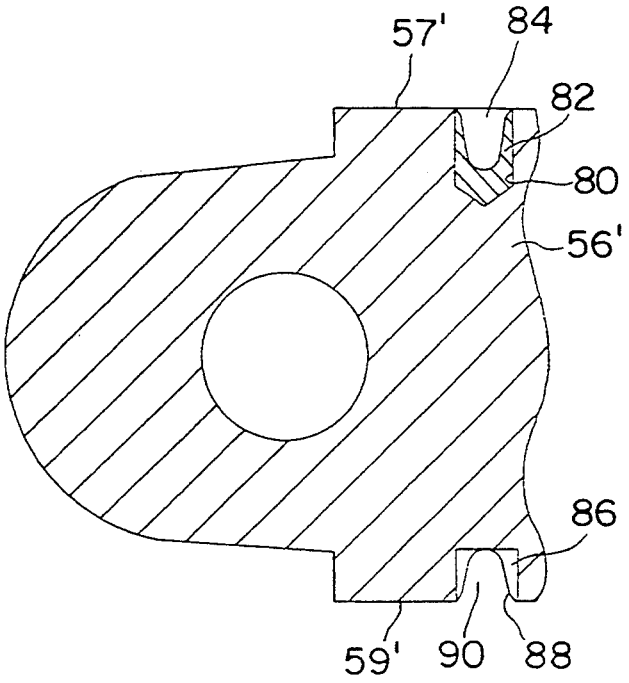
FIG. 5 is an enlarged section view of the adapter and the pin showing an alternative embodiment of the adapter.

Referring to FIG. 5, an alternative embodiment has a registration adapter 56' made from aluminum. The registration adapter 56' has a hole 80 on the surface 57' for receiving a steel bushing 82. The steel bushing has a hole 84 with a tapered shape for receiving the pin 64. The registration adapter 56' has a slot 86 on the surface 59' which receives a strip 88 of spring steel. The strip 88 forms slot 90 for receiving a pin 64. The registration adapter 56' is mounted similarly to the previous embodiment in that the two registrations adapters 56' are identical and one is positioned so that the hole 58 projects downward and the other is positioned so that the slot 60 is positioned downward.

The present invention may be embodied in other specific forms without departing from the spirit or essential attributes thereof and, accordingly, reference should be made to the appended claims, rather than to the foregoing specification, as indicating the scope of the invention.

I claim:

1. A registration apparatus for a printing screen and an image platform, the apparatus comprising:

a screen tensioning and printing frame, the frame having a plurality of rollers coupled together by corner members which support the rollers for rotation about their longitudinal axes, each roller having a means for retaining an edge portion of a screen fabric, means associated with each corner member for locking each roller in a predetermined rotative position so that a desired tension may be applied to the screen fabric, the means for locking one of the roller having a pair of fasteners, each fastener extending through the associated corner member into engagement with the roller and a pair of adapters interposed between the fasteners and the associated corner member, a registration member associated with the image platform, and the adapter and the registration member having coupling means for removable linking the printing frame to the registration member, the coupling means having a pair of pins received by a hole and a slot.

2. A registration apparatus for a printing screen and a image platform, the apparatus comprising:

a screen tensioning and printing frame, the frame having a plurality of rollers, each roller having a means for retaining an edge portion of a screen fabric and a pair of ends, an end plug mounted on each end of the roller, each end plug containing a nut aligned along a longitudinal axes of the roller, the frame having a plurality of corner members, the frame having a plurality of bolts, each bolt having a head, a shaft and a threaded portion, the shaft of the bolt extending through the corner member and the threaded portion received by the nut of the end plug for coupling the roller to the corner member for rotation of the roller about its longitudinal axes and for locking each roller in a predetermined rotative position so that a desired tension may be applied to a screen fabric, a pair of adapters associated with one of the rollers and interposed between the head of the bolts of one of the rollers and the corner members, one of the adapters having a hole, the other adapter having a slot, and a registration member associated with the image platform having a plurality of pins, one of the pins aligned and receivable by the hole of one of the adapters and another pin aligned and receivable by the slot of the other adapter wherein the rollers are capable of rotation about their longitudinal axes to a predetermined rotative position.

3. A registration apparatus for a printing screen and a image platform, the apparatus comprising:

a screen tensioning and printing frame, the frame having a plurality of rollers, each roller having a means for retaining an edge portion of a screen fabric and a pair of ends, an end plug mounted on each end of the roller, each end plug containing a nut aligned along a longitudinal axes of the roller, the frame having a plurality of corner members, the frame having a plurality of bolts, each bolt having a head, a shaft and a threaded portion, the shaft of the bolt extending through the corner member and the threaded portion received by the nut of the end plug for coupling the roller to the corner member for rotation of the roller about its longitudinal axes and for locking each roller in a predetermined rotative position so that a desired tension may be applied to a screen fabric, a pair of adapter associated with one of the rollers and interposed between the head of the bolts of the one of the rollers and the corner members, the adapters each having a hole and a slot, and a registration member associated with the image platform having a plurality of pins, one of the pins aligned and receivable by the hole of the one of the adapters and another pin aligned and receivable by the slot of the other adapter wherein the rollers are capable of rotation about their longitudinal axes.

* * * * *